United States Patent [19]

Roestenberg

[11] Patent Number: 4,766,701

[45] Date of Patent: Aug. 30, 1988

[54] VACUUM RASP

[76] Inventor: Jerome R. Roestenberg, 11 Woodpecker La., Levittown, N.Y. 11756

[21] Appl. No.: 31,052

[22] Filed: Mar. 27, 1987

Related U.S. Application Data

[63] Continuation-in-part of Ser. No. 902,852, Sep. 2, 1986, Pat. No. 4,680,895.

[51] Int. Cl.[4] ..... B24B 23/00

[52] U.S. Cl. ..... 51/170 R; 51/273

[58] Field of Search ..... 51/273, 170 R, 170 T, 51/180, 205 R; 15/393

[56] References Cited

U.S. PATENT DOCUMENTS

| | | | |
|---|---|---|---|
| 1,800,341 | 4/1931 | Davies | 51/170 T |
| 2,499,933 | 3/1950 | Smul . | |
| 3,673,744 | 7/1972 | Oimoen . | |
| 3,785,092 | 1/1974 | Hutchins . | |
| 3,824,745 | 7/1974 | Hutchins . | |
| 3,837,383 | 9/1974 | Ko . | |
| 3,935,678 | 2/1976 | Marton . | |
| 4,062,152 | 12/1977 | Mehrer | 51/170 R |
| 4,071,981 | 2/1978 | Champayne . | |
| 4,135,334 | 1/1979 | Rudiger . | |
| 4,145,848 | 3/1979 | Hutchins . | |
| 4,184,291 | 1/1980 | Marton | 51/170 R |
| 4,215,473 | 8/1980 | Elmore | 51/205 R |
| 4,328,645 | 5/1982 | Sauer . | |
| 4,616,449 | 10/1986 | Marton . | |
| 4,680,895 | 7/1987 | Roestenberg | 51/273 |

*Primary Examiner*—Roscoe V. Parker

*Attorney, Agent, or Firm*—Nolte, Nolte and Hunter

[57] ABSTRACT

A hand-powered vacuum abrading apparatus having a housing within which a partial vacuum is established, the bottom of the housing comprising an abrading work surface, including a plurality of downward facing openings for receiving air and abraded particles from the surface being abraded into the housing, the abrading surface including abrading elements which extend below a substantial portion of the openings, the apparatus including a grip for hand pressing it against and moving it across the work surface.

8 Claims, 3 Drawing Sheets

VACUUM RASP

CROSS-REFERENCE TO RELATED APPLICATION

This application is a continuation-in-part of patent application Ser. No. 902,852, now U.S. Pat. No. 4,680,895.

BACKGROUND OF THE INVENTION

1. Field of the Invention

In general this invention relates to abraders and in particular to a hand operated vacuum abrading apparatus for use with an external vacuum source.

2. Description of the Prior Art

Vacuum abrading apparatus presently available generally comprises a motor driven moving abrading surface surrounded by a suction hood with suction generated by an external abrading motor or by an external vacuum source. Examples of these arrangements may be found in U.S. Pat. Nos. 3,673,744 Portable Grinder granted to Anders Oimoen; 3,785,092 Abrading Tool Having Suction System For Collecting Abraded Particles, 3,824,745 Suction System For Abrading Tool, and 4,145,848 Rotary Abrading Tool, granted to Alma A. Hutchins; 4,071,981 Portable Abrading Machine With Dust Collecting System granted to Roy J. Champayne; and 4,135,334 Dust Exhaust Hood granted to Gunter Rudiger.

Although these tools may adequately perform to their intended purpose, to abrade and remove the dust and chips generated by abrading, they tend to be heavy and bulky. They generally remove dust and chips by first moving the undesired material as it is trapped between the abrading and work surfaces, until it reaches the edge of the abrading surface for subsequent pick up by suction. Often abrading surface replacement is difficult or time consuming.

The present invention overcomes the above problems by removing the particles about the time and location that they are generated. It is lightweight, relatively quiet, coupled to external vacuum source and hand operated, performing its intended task without a motor and its attendant weight and bulk.

SUMMARY OF THE INVENTION

It is one object of the invention to provide a vacuum abrader which is hand operated.

It is another object to provide a vacuum abrader which is relatively quite and lightweight.

Another object is to remove dust and chips of abrading closer to the moment and location of their generation.

Another object is to reduce interference of chips and dust with the abrading process.

Another object is to permit easy replacement and change of abrading surface type without degredation of the tool's performance.

Other objects and advantages will become apparent from the ensuing description.

In accordance with the present invention there is provided a vacuum abrading tool that is hand operated, having a substantially airtight housing. A coupling for attachment to a vacuum source is attached to and in communication with the housing for establishing a partial vacuum within the housing. An abrading surface occupies a substantial portion of the housing's bottom and includes a plurality of downward facing openings therethorough for receiving air and abraded particles from under the surface, into the housing, for removal by the vacuum source. Means are provided for gripping the tool for pressing against and moving it across the work surface. Means for temporarily attaching the abrading surface and sealing means to help maintain housing airtight integrity with abrading surface change, are also provided. It is within the contemplation of the invention to include the abrading surface in U shaped form whereby a portion of the downward facing openings may be distanced from the work surface during work. Downwardly depending skirts are provided, attached to the housing and extending to the work surface when the U shaped surface is in contact with the work surface. The skirts further aid in dust and chip removal from the work surface, although the greater portion of the instantly generated particles are removed by openings closest to the work surface.

BRIEF DESCRIPTION OF THE DRAWINGS

In order that the invention may be more fully comprehended, it will now be described, by way of example, with reference to the accompanying drawings, in which.

Figure 1:
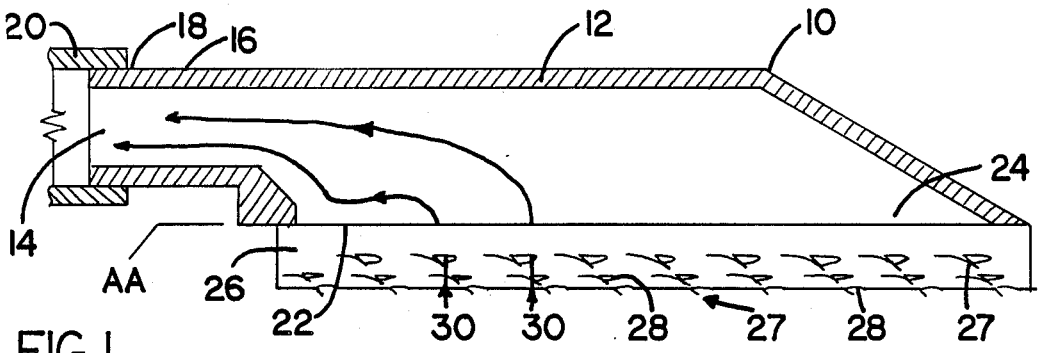
FIG. 1 is a side view in partial cross section above plane AA of the invention with a U shaped rasp surface.

Before explaining the invention in detail it is to be understood that the invention is not limited in its application to the exact details of construction and arrangement of parts illustrated in the drawings since the invention is capable of other embodiments and of being practiced or carried out in various ways. It is also to be understood that the phraseology or terminology employed is for the purpose of description and not of limitation.

Turning now to the vacuum rasp 10 in FIG. 1, there is provided an substantially airtight housing 12 having a rearward communicating opening 14 in tubular handle 16 which has its end 18 shaped for temporarily, joining sealingly with vacuum source 20 for establishing a partial vacuum within the housing.

The lower forward portion 22 of housing 12 includes bottom-facing opening 24 established along a substantial length of the lower forward portion 22. Within the opening, is sealingly mounted downwardly extending U shaped rasp surface 26, having a plurality of teeth 27, and a plurality of openings 28 therethrough for receiving air and rasping dust and chips into the housing, drawn by the vacuum within the housing, for removal from the housing by the vacuum source. The airflow paths are represented in part by arrows 30.

Figure 2:
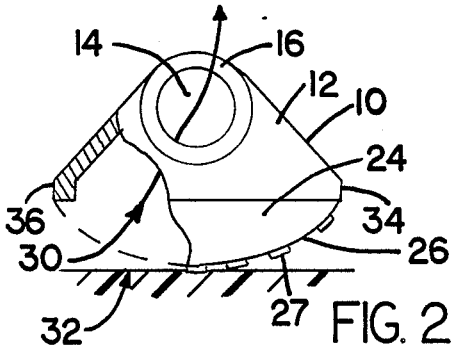
FIG. 2 is a rear view in partial cut away.

By reference to FIG. 2, it will be noted that air is drawn in at various angles from a horizontal work surface plane 32 which is tangent to the U shaped rasp surface. The vacuum is preferably made strong enough to draw the chips up from the work surface 32 located under entire rasp surface 26, including to its lateral edges 34 and 36.

The rasp surface may be made by conventional means such as punching and deforming sheet metal to provide both opening 28 and tooth 27. Alternatively it may be made by drilling or otherwise forming openings 28 through a surface which is textured for removing material by abrading, scraping, or combination of scraping and abrading such as by file teeth, bonded tungsten carbid, garnet particles, or raised sculptured interruptions of the surface. The size, shape and height of each tooth may vary according to the various designs available in the abrading tool art.

Figure 3:
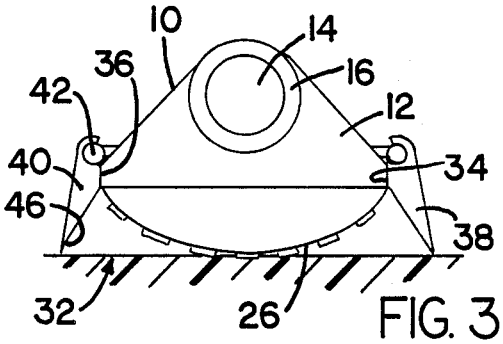
FIG. 3 is a rear view of one embodiment of the invention showing skirts.

In another embodiment, shown in FIG. 3, a pair of skirts 38 and 40, depend from housing 12, close to and along its lateral edges 34 and 36 respectively. Preferably flexible, the skirts are attached to the body by hinges 42. The skirts each include a flat stop portion which rests against the housing when the vacuum rasp is lifted directly up from the work surface, and further include outwardly biased portion 46 which is sufficiently angled from the vertical so that the skirt in contact with the work surface is rotated away from the housing when any portion of U shaped rasp surface 26 is placed on the work surface. Skirts 38 and 40 are of sufficient vertical length to contact the work surface when the vacuum rasp is rotated from the vertical, but not necessarily for rotation to all angles that may be encountered when the U shaped rasp surface is employed against the work surface. The skirts permit using less vacuum to draw the chips into housing 12, than is required for the embodiment shown in FIG. 1. Although they are flexible, they are not so flexible as to be substantially deformed by the partial vacuum or air stream to be drawn inwardly. Their longitudinal ends may be chamfered to avoid catching on the work surface.

Means for mounting the skirts to the housing to aid in chip removal to within the housing, and for permitting skirt contact with the work surface when the vacuum rasp is rotated from the vertical as described eariler, are not limited to the hinge arrangement of FIG. 3.

Figure 5:
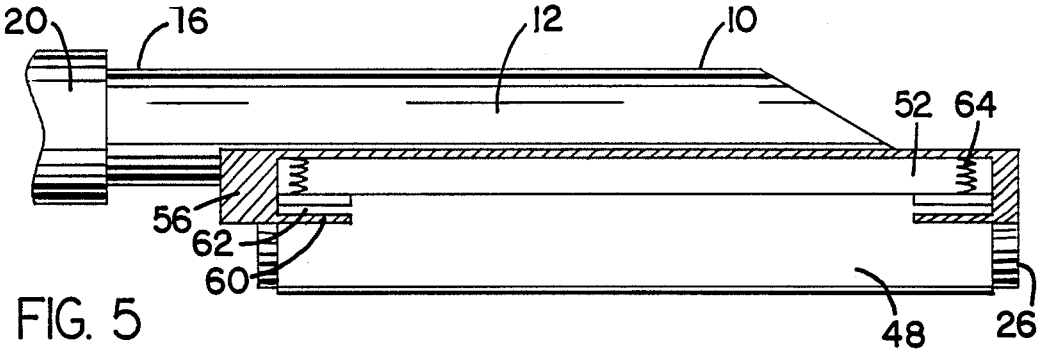
FIG. 5 is a side view showing the skirts of FIG. 4 in cross section.
Figure 4:
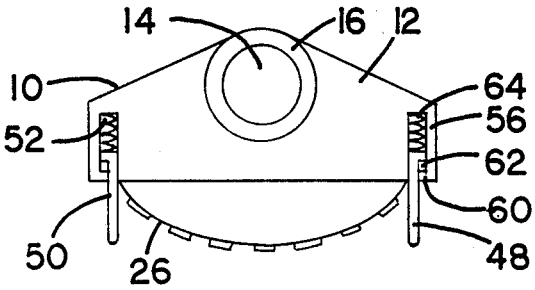
FIG. 4 is a rear view of another embodiment, showing skirts.

For example, vacuum rasp 10 shown in FIGS. 4 and 5 includes downward depending skirts 48 and 50, located close to, and along lateral edges 34 and 36. The skirts are slidably mounted in channels 52 which are formed by retaining walls 56. A flange 60 on each retaining wall engages rectangular recess 62 on each skirt, serving to limit the upward and downward travel of the skirt. Spring 64 in each channel urges the respective skirt downward so that it contacts the work surface when the U shaped rasp surface is employed against it as described eariler. Other means such as gravity or magnetic repulsion for example, may be used to urge the skirt downward, but a spring is preferable.

Figure 6:
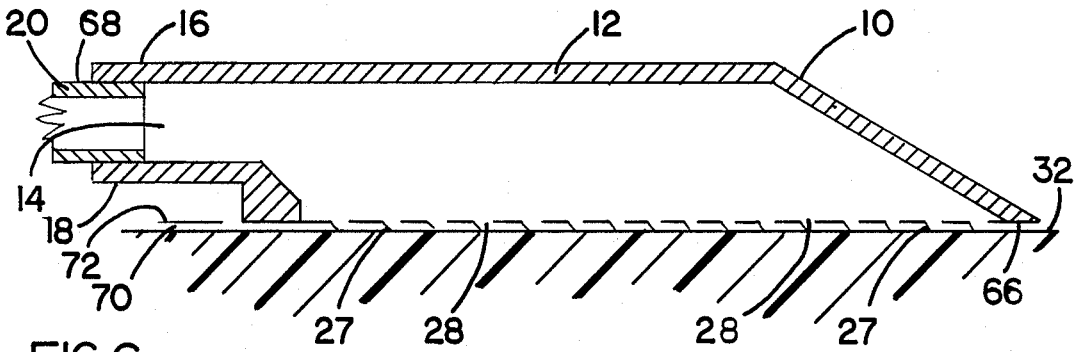
FIG. 6 is a side cross section view showing the invention with a planar lower rasp surface.

FIG. 6 shows a vacuum rasp in which the lower forward portion of housing 12 includes a planar lower rasp surface 66. The essentially airtight housing includes, at its rearward portion, tubular handle 16 which has its end 18 shaped for temporarily joining sealingly with vacuum source 20 for establishing a partial vacuum in the housing, by receiving vacuum source tube 68 within handle 16 opening 14. Openings 28 are provided in planar rasp surface 66, for receiving air and rasping chips into the housing, drawn by the partial vacuum within the housing, for removal from the housing by means of the vacuum source, by way of opening 14 in tubular handle 16. Space 70, (FIG. 7), is established between the plane 72 of openings 28 and the work surface plane 32 by the length of teeth 27.

This space is also facilitated by one way cutting rasp type teeth during the non-cutting stroke of the rasp and, by bonded particle and sculptured surface teeth, as weel as file-type ridges, at the start of strokes and during stroking as they cross irregularities generated in the work surface. The space permits airflow path 30 to be established as work is performed by the vacuum rasp.

Figure 7:
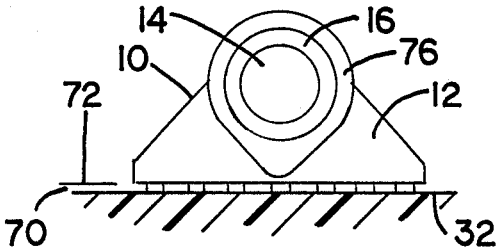
FIG. 7 is a rear view of one embodiment with rear handle.
Figure 8:
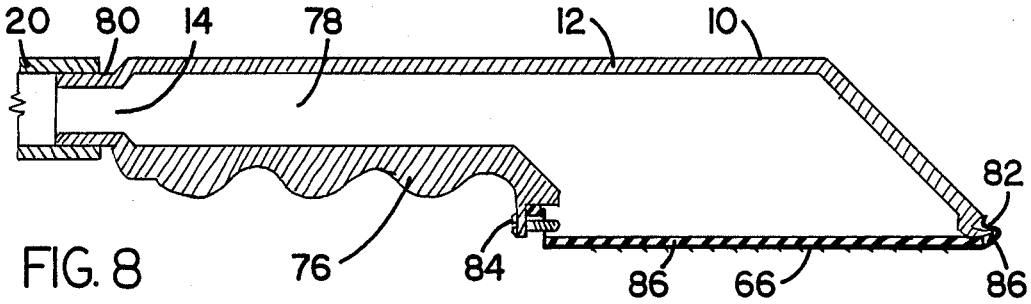
FIG. 8 is a side cross sectional view of an embodiment with replaceable abrading surface.

FIGS. 7 and 8 illustrate another embodiment of the invention. They show a vacuum rasp in which housing 12 includes a rigid handle 76, extending rearward of the housing, the handle includes an integral passageway 78, terminating in a fitting 80 adapted for temporarily joining sealingly with vacuum source 20.

Figure 8B:
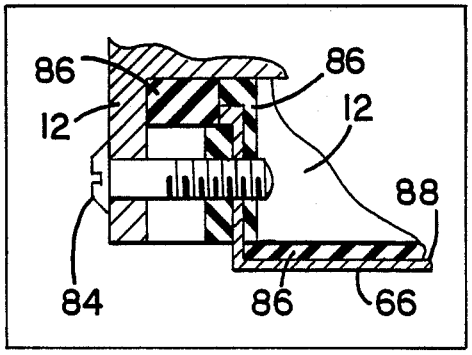
FIGS. 8A and 8B are enlarged partial cross-sectional views illustrating details of the resilient seal used with the replaceable abrading surface of FIG. 8.
Figure 8A:
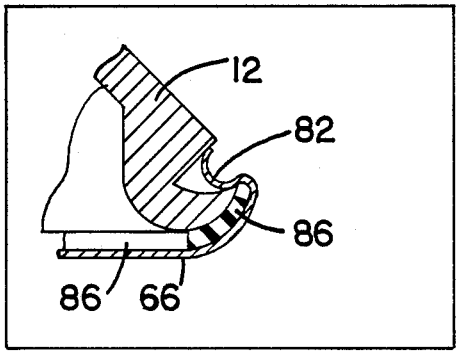

Rasp or other abrading surfaces for the vacuum rasp may be joined with the housing by conventional means known to the manufacturing art, for example a rasp surface may be molded as a metal component with the housing made from reinforced plastic. Another way, illustrated in FIG. 8, comprises attaching the rasp surface by flange 82 and draw screw 84 similar to the lock-up arrangement of the Stanley SURFOAM brand rasp tool. Where the rasp surface is replaceable by this or similar assembly arrangement, there is included tough resilient sealing 86, FIGS. 8A, 8B, between the housing and either the upper rasp surface 88 or the lower rasp surface, as required in order to approach housing air tight integrity.

Figure 9:
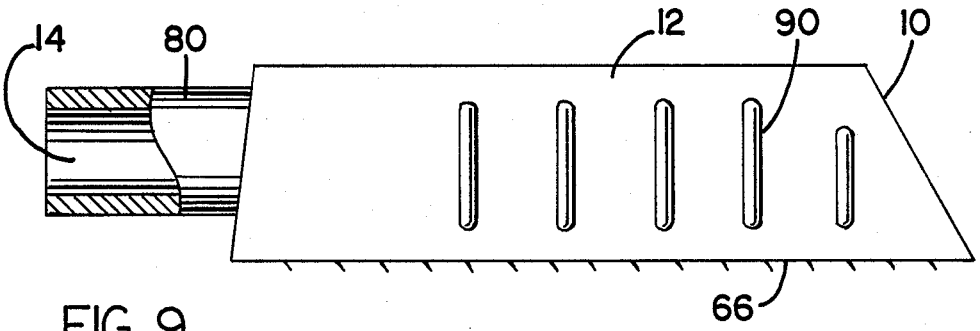
FIG. 9 is a side view of one embodiment of the invention with hand grip housing.

A compact vacuum rasp for hard to get at surfaces is shown in FIG. 9, wherein its housing 12 comprises directly extending fitting 80 for temporarily joining sealingly with vacuum source 20, and which further includes hand-gripping ribs 90. Planar lower rasp surface 66 is shown, but should be understood that U shaped rasp surface 26 or other abrading surfaces with openings 28 may alternatively be employed.

In operation, the vacuum rasp is connected by fitting 80 or end 18 of its tubular handle, to vacuum source 20, wherein vacuum is provided by a portable large capacity vacuum cleaner or similar means. Depending upon the embodiment of the present invention used, the vacuum rasp is hand-held by tubular handle 16, rigid handle 76 or by gripping ribs 90 on the housing, and reciprocated over the work surface, with its abrading surface, such as U shaped rasp surface 26, planar rasp surface 66 or a bonded garnet surface, pressed against the work surface. Dust and chips from the work surface generated by the work are carried in the air flow, as air sweeps across the work surface in proximity to the tool's lateral edges 34 and 36, across momentarily and repeatedly established space 70, and into the housing via the plurality of openings 28.

Replacement of the abrading surface is accommplished by removing draw screw 84 that is holding one end of the outer surface, and detaching the other end of the surface from the housing at flange 82. A new surface is then selected for the job required and, after attachment at flange 82, is brought against seals 86 to reestablish air tight seal at its appropriate upper and lower surface edges. It is then drawn tight by draw screw 84.

When a U shaped rasp or abrading surface is used on a work surface which does not conform to its U shaped radius, a portion of openings 28 may be distanced from the work surface further than is practical for drawing chips into them. It is then that the tool with skirts 38 and 40 are used. In the skirted tool, sweep air is received between the skirt and the housing wall from the lateral end of the skirts, from under the skirts as they pass over irregularities in the work surface, and from under the lower margin of a skirt when it is lifted during tool tilt. As noted earlier, although the skirts may extend to a plane below the abrading surface, they need not be long enough to simultaneously contact the work surface when the tool is rotated. Thus, the tool may be operated rotated from the vertical so that skirt 38 and a portion of U shaped rasp surface 26 is in contact with the work surface, while skirt 40 depends downward along the side of the housing with its lower margin spaced ever so slightly from the work surface. Sufficient sweep air is thus variously provided to aid in removing the chips from the work surface to within the housing and from there, by way of rearward opening 14, to the vacuum source.

From the foregoing description, it will be seen that the invention provides a vacuum rasp which is relatively quiet and lightweight for hand operation, which removes dust and chips generated by scraping and abrading from the work surface for handling safety and for its visibility, and which reduces airborn dust pollution for lung and eye safety, and which permits replacement of various abrading surfaces without loss of mechanical integrity and function.

Although the invention has been described in specific terms, it will be understood that various changes may be made in size, shape and materials, and in the arrangement of parts without departing from the spirit and scope of the invention as claimed.

Having thus set forth the nature of the invention, what is claimed is:

1. A hand powered vacuum abrading apparatus comprising:

a substantially airtight housing, said housing having a forward end, a rear end, and a bottom, means for coupling to a vacuum source, said coupling means being attached to and in communication with said housing for establishing a partial vacuum within said housing, a surface for abrading a work surface, means for attaching said surface for abrading to said bottom, said surface for abrading occupying a substantial portion of said bottom without intervening back up plate or pad supporting said surface for abrading and, including a plurality of downward facing openings therethrough for receiving air and abraded particles from under said surface, into said housing, for removal from said housing by said vacuum source and, said surface for abrading including abrading elements which extend below a substantial portion of the downward facing openings, means for gripping said apparatus for pressing it against and moving it across said work surface.

2. The invention as set forth in claim 1 further including:

said means for attaching said surface for abrading comprising means for temporarily attaching said surface for abrading, and means for sealing between the surface for abrading and the housing, said means for sealing being so located that a substantially airtight seal is established between the housing and the surface for abrading around its population of downward facing holes.

3. The invention as set forth in claims 1 or 2 further comprising:

said surface for abarding is formed in a downwardly extending U shape about an axis extending generally between the forward and rear ends of the housing.

4. The invention as set forth in claim 2 wherein:

said means for temporarily attaching said surface for abrading comprises, in combination, a flange on said housing and means for simultaneously drawing the abrading surface unilaterally across the housing into locking engagement with the flange and into intimate contact with the means for sealing.

5. A hand powered vacuum abrading apparatus comprising:

a substantailly airtight housing, said housing having a forward end, a rear end, and a bottom, means for coupling to a vacuum source, said coupling means being attached to and in communication with said housing for establishing a partial vacuum within said housing, a surface for abrading a work surface, means for attaching said surface for abrading to said bottom, said surface for abrading occupying a substantial portion of said bottom and including a plurality of downward facing openings therethrough for receiving air and abraded particles from under said surface, into said housing, for removal from said housing by said vacuum source and, said surface for abrading including abrading elements which extend below a substantial portion of the downward facing openings, means for gripping said apparatus for pressing it against and moving it across said work surface, said surface for abrading being formed in a downwardly extending U shape about an axis extending generally between the forward and rear ends of the housing, a pair of downwardly depending skirts, attached to the housing, generally parallel to said axis along the length of the U shaped surface, and extending generally to the work surface when the surface for abrading is in contact with the work surface, and means for attaching said skirts for independent articulation of said skirts toward said work surface when the U shaped surface is rotated on the work surface.

6. A hand powered vacuum abrading apparatus comprising:

a substantially airtight housing, said housing having a forward end, a rear end, and a bottom, means for coupling to a vacuum source, said coupling means being attached to and in communication with said housing for establishing a partial vacuum within said housing, a surface for abrading a work surface, means for attaching said surface for abrading to said bottom, said surface for abrading occupying a substantial portion of said bottom and including a plurality of downward facing openings therethrough for receiving air and abraded particles from under said surface, into said housing, for removal from said housing by said vacuum source and, said surface for abrading including abrading elements which extend below a substantial portion of the downward facing openings, means for gripping said apparatus for pressing it against and moving it across said work surface, said means for attaching said surface for abrading comprising means for temporarily attaching said surface for abrading, and means for sealing between the surface for abrading and the housing, said means for sealing being so located that a substantially airtight seal is established between the housing and the surface for abrading around its population of downward facing holes, said surface for abrading being formed in a downwardly extending U shape about an axis extending generally between the forward and rear ends of the housing, a pair of downwardly depending skirts, attached to the housing, generally parallel to said axis along the length of the U shaped surface, and extending generally to the work surface when the surface for abrading is in contact with the work surface, and means for attaching said skirts for independent articulation of said skirts toward said work surface when the U shaped surface is rotated on the work surface.

7. The invention as set forth in claim 5 or 6 wherein:

one of said said means for attaching said skirts for independent articulation comprises a hinge, and the skirt attached by said hinge includes a portion biased outwardly sufficiently so that said skirt, when in contact with the work surface, is rotated away from the housing when the U shaped surface is placed on the work surface.

8. The invention as set forth in claim 5 or 6 wherein:

one of said means for attaching said skirts for independent articulation comprises channel means for slidably retaining the skirt, and means for limiting the vertical travel of the skirt within said channel.

* * * * *

UNITED STATES PATENT AND TRADEMARK OFFICE

CERTIFICATE OF CORRECTION

PATENT NO. : 4,766,701

DATED : August 30, 1988

INVENTOR(S) : Jerome R. Rosenberg

It is certified that error appears in the above-identified patent and that said Letters Patent are hereby corrected as shown below:

In Column 6, line 9, "abarding" should be --abrading--.

In Column 6, line 22, "substantailly" should be --substantially--.

Signed and Sealed this

Seventeenth Day of January, 1989

*Attest:*

DONALD J. QUIGG

*Attesting Officer*

*Commissioner of Patents and Trademarks*